United States Patent [19]

Török et al.

[11] Patent Number: 4,967,119

[45] Date of Patent: Oct. 30, 1990

[54] AIR TRANSPORTING ARRANGEMENT

[75] Inventors: Vilmos Török, Lidingö; Andrzej Loreth, Åkersberga, both of Sweden

[73] Assignee: Astra-Vent AB, Stockholm, Sweden

[21] Appl. No.: 199,259

[22] PCT Filed: Dec. 2, 1986

[86] PCT No.: PCT/SE86/00547

§ 371 Date: May 27, 1988

§ 102(e) Date: May 27, 1988

[87] PCT Pub. No.: WO87/04019

PCT Pub. Date: Jul. 2, 1987

Related U.S. Application Data

[63] Continuation-in-part of Ser. No. 31,010, Jan. 13, 1987, Pat. No. 4,812,711.

[30] Foreign Application Priority Data

Dec. 20, 1985 [SE] Sweden ..... 8506068
Mar. 3, 1986 [SE] Sweden ..... 8604219

[51] Int. Cl.[5] ..... H01J 7/24; H01T 23/00

[52] U.S. Cl. ..... 315/111.91; 417/48; 430/937; 261/DIG. 42; 313/231.41

[58] Field of Search ..... 315/111.21, 111.01, 315/111.91, 111.81; 313/231.41, 7, 359.1, 103 R, 233; 261/DIG. 42; 430/937; 417/48, 49

[56] References Cited

U.S. PATENT DOCUMENTS

| | | | |
|---|---|---|---|
| 2,279,586 | 4/1942 | Bennett | 315/111.91 |
| 2,765,975 | 10/1956 | Lindeblad | 315/111.91 |
| 3,374,941 | 3/1968 | Okress | 417/48 |
| 3,699,387 | 10/1972 | Edwards | 315/111.01 |
| 4,380,720 | 4/1983 | Fleck | 315/111.91 |
| 4,812,711 | 3/1989 | Torok et al. | 315/111.91 |

FOREIGN PATENT DOCUMENTS 2854716 12/1978 Netherlands .

*Primary Examiner*—Eugene R. LaRoche
*Assistant Examiner*—Michael B. Shingleton
*Attorney, Agent, or Firm*—Browdy and Neimark

[57] ABSTRACT

An arrangement for transporting air with the aid of so-called ion-wind which includes at least one corona electrode and at least one target electrode is shown and described. The corona electrode is a thin wire electrode passing from one side of a duct to another, and the target electrode has a shape such that the distance between the corona electrode and the target electrode is less in the region of the corona electrode ends than in the corona electrode middle. This placement of the electrodes closer together at the ends of the wire electrode provides a uniform corona current over the whole length of the elongated corona electrode which provides the most uniform air flow over the entire cross-sectional area of the duct in which the electrodes are mounted.

13 Claims, 2 Drawing Sheets

AIR TRANSPORTING ARRANGEMENT

This application is a continuation-in-part of U.S. patent application Ser. No. 07/031,010, filed Jan. 13, 1987, entitled CORONA DISCHARGE AIR TRANSPORTING ARRANGEMENT, now U.S. Pat. No. 4,812,711, issued Mar. 14, 1989.

The present invention relates to an arrangement for transporting air with the aid of a so-called ion wind or corona wind and being of the kind set forth in the pre-characterizing clause of claim 1.

BACKGROUND OF THE INVENTION

1. Field of the Invention

It is known that air can, in principle, be transported with the aid of a so-called electric ion-wind or corona-wind. An electric ion-wind is created when a corona electrode and a target electrode are placed at a distance from one another and each connected to a respective terminal of a d.c. voltage source, the corona electrode and the d.c. voltage source being such as to cause a corona discharge at the corona electrode. This corona discharge results in ionization of the air, with the air ions having the same polarity as the polarity of the corona electrode, and possibly also in the production of electrically charged aerosols, i.e. air-suspended solid particles or liquid droplets which are electrically charged as a result of collisions with the electrically charged air ions. The air ions move rapidly from the corona electrode to the target electrode, under the influence of the electric field, where they relinquish their electric charge and return to electrically neutral air molecules. During their movement from the corona electrode to the target electrode, the air ions are in constant collision with the electrically neutral air molecules, therewith transferring electrostatic forces to the neutral air molecules, so as to draw these molecules from the corona electrode to the target electrode, resulting in the transportation of air in the form of a so-called ion wind or corona wind.

2. Description of the Related Art

Earlier proposed arrangements for transporting air with the aid of ion-wind are found described, for example, in DE-OS-2854716, DE-OS-2538959, GB-A-2112582, EP-A1-29421, U.S. Pat. No. 3,374,941 and U.S. Pat. No. 4,380,720. These prior art arrangements have been found extremely ineffective, however, and have not achieved any significance in practice. Air transporting arrangements which utilize the ion-wind principle and which display marked improvements over the aforesaid known arrangements, both with regard to efficiency and to practical utility, are described in our international patent application PCT/SE85/00538.

SUMMARY OF THE INVENTION

It has been found, however, that air transporting arrangements of this latter kind are encumbered with a particular problem, especially when there is used an elongated corona electrode, for example an electrode which comprises one or more mutually parallel, rectilinear thin wires which extend across the airflow path between suitably constructed holders at the ends of the electrode. When using a corona electrode of this kind it has been found that the electrode tends to produce a much higher corona current per unit of length in the region of its centre, i.e. within the central region of the airflow path, than at its end regions. It would seem that this phenomenon is the result of a screening effect created by the fasteners securing the ends of the electrode, and by the wall of the airflow duct normally surrounding the electrode arrangement. In the case of low corona currents, a major part of the two end portions of the corona electrode may even be "extinguished". This phenomenon results in uneven distribution of the ion current over the whole cross-section of the airflow path and therewith in uneven flow velocity within said path. In those cases where the airflow passage is defined by duct walls, those parts of the path cross-section that are located axially opposite the two end parts of the corona electrode may even have an airflow which is counterdirectional to that desired. The phenomenon is particularly paramount in the case of airflow ducts which have a narrow, elongated rectangular or slit-like cross-section. It will be understood that this phenomenon greatly impairs the total air throughput of the arrangement. In an extreme case, the transportation of air through the duct may cease altogether.

The object of the present invention is to provide an air transporting arrangement of the kind described in the introduction with which the aforementioned problems are no longer found.

This is achieved in accordance with the invention by means of an arrangement of the construction defined in the following claims.

The invention will now be described in more detail with reference to the accompanying drawings, in which

DETAILED DESCRIPTION OF THE PREFERRED EMBODIMENTS

Figure 1:
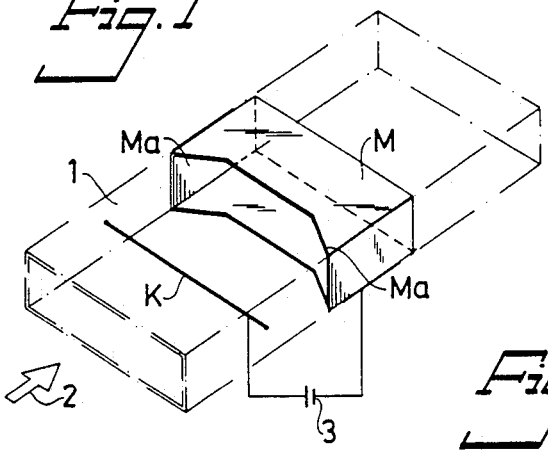
FIGS. 1–3 illustrate in perspective and by way of example various embodiments of the invention in which the target electrode comprises electrically conductive surfaces located on or adjacent the wall of an airflow duct surrounding the path of air flow.

FIG. 1 illustrates schematically an air transporting arrangement which operates in accordance with the ion wind principle. The arrangement includes an airflow duct 1, shown in chain lines, a corona electrode K, and a target electrode M. The electrodes are spaced axially apart within the airflow duct 1, with the target electrode M located downstream of the corona electrode K, as seen in the desired direction 2 of air flow through the duct 1. In the illustrated embodiment the airflow duct 1 has a narrow, elongated rectangular or slit-like cross-section. The corona electrode K comprises a thin, rectilinear wire which extends across the airflow duct 1 along the major axis of the rectangular cross-section of the duct, whereas the target electrode M comprises an electrically conductive surface, or coating which is applied adjacent to or directly on the inner surface of the duct wall, and which extends fully around the wall. The corona electrode K and the target electrode M are each connected to a respective terminal of a d.c. voltage source 3. The voltage of this source is such as to create a corona discharge at the corona electrode K, thereby generating air ions which migrate to the target electrode under the influence of the electric field, thereby creating an airflow 2 through the duct 1. With regard to a more detailed description of the manner in which the illustrated arrangement operates, the reader is referred to the complete description found in the aforementioned international patent application.

In order to obtain substantially uniform distribution of the corona current along the whole length of the corona electrode K, and therewith a uniform flow of air over the entire cross-section of the airflow duct 1, the electrically conductive surface constituting the target electrode M of the embodiment illustrated in FIG. 1 is formed so as to present at a location axially opposite the end parts of the corona electrode K, surface parts Ma which are situated at a shorter axial distance from the cross-sectional plane that contains the corona electrode K than the parts of the target electrode M located axially opposite the centre part of the corona electrode K. It has been found that the corona current can be distributed more uniformly along the whole length of the corona electrode K, when the target electrode M is constructed in this manner.

With an air transporting arrangement constructed in accordance with the invention, the target electrode may incorporate a plurality of mutually separated, electrically conductive surfaces or electrode elements that are connected to mutually different potentials, all having, however, the same polarity relative the potential of the corona electrode.

Figure 2:
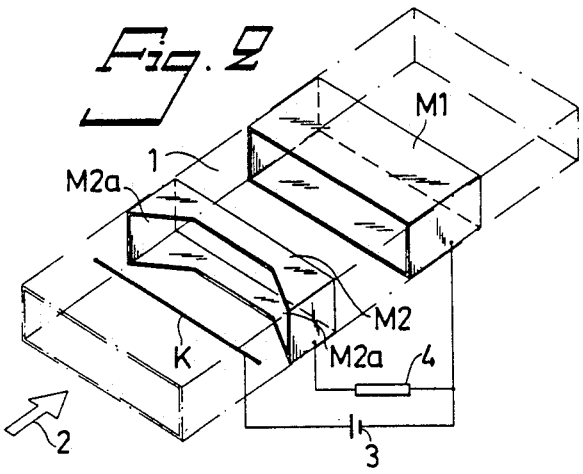

FIG. 2 illustrates schematically and by way of example, an embodiment of the invention in which the target electrode has the aforedescribed form. As with the embodiment illustrated in FIG. 1, the FIG. 2 embodiment includes an airflow duct 1 of elongated rectangular or slit-like cross-section, a corona electrode K in the form of a thin, rectilinear wire which extends across the airflow duct 1, and a first target electrode M1 in the form of an electrically conductive surface or coating applied adjacent to or on the inner surface of the wall of the airflow duct 1 such as to extend fully therearound, the corona electrode K and the target electrode M each being connected to a respective terminal of the d.c. source 3. In addition hereto, the FIG. 2 embodiment also includes a second target electrode M2 which, similar to the first electrode M1, comprises an electrically conductive surface or coating arranged adjacent to or on the inside surface of the wall of the airflow duct 1 and extends fully around the duct, this second target electrode M2 being connected to the same terminal of the d.c. voltage source 3 as the first target electrode M1 through a large resistance 4. Consequently, the second electrode M2 will only receive and conduct a small part of the total ion flow from the corona electrode K and will adjust to a potential which may differ from the potential of the first target electrode M1, but which, of course, has in relation to the potential of the corona electrode K, the same polarity as the potential of the first target electrode M1. The two electrodes M1 and M2 can be said to form together a target electrode arrangement for the ion current from the corona electrode K. The objective of the second target electrode M2 and the manner in which it functions are described more fully in the aforementioned international patent application. In the exemplifying embodiment of the invention illustrated in FIG. 2, the first target electrode M1 has a uniform axial extension around the full circumference of the duct 1. The second target electrode M2, on the other hand, which is located closer to the corona electrode than the first electrode M1, has the same form as the target electrode M in the FIG. 1 embodiment. The electrically conductive surface or coating forming the second electrode M2 thus has parts M2*a* which extend axially towards the corona electrode, or wire K at regions opposite respective end parts of the corona electrode, and which are thus located at a shorter axial distance from the cross-sectional plane incorporating the corona electrode K than the remaining parts of the second target electrode M2 located opposite the centre section of the corona electrode K. As a result, the corona current will be distributed uniformly over the whole length of the corona electrode K, in the manner desired.

In the case of an air transporting arrangement provided with a second target electrode M2 in the manner illustrated in FIG. 2, the first target electrode M1 may be given the same form as the target electrode M illustrated in FIG. 1, so that both the electrode M2 and the electrode M1 extend closer to the corona electrode K at regions located axially opposite the end parts of said corona electrode.

Figure 3:
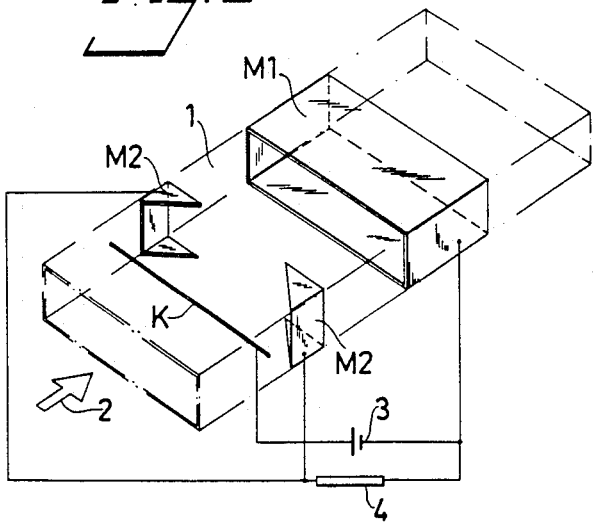

FIG. 3 illustrates schematically and by way of example a further conceivable embodiment of the invention. Similar to the arrangements illustrated in FIGS. 1 and 2, the arrangements illustrated in FIG. 3 includes an airflow duct 1 having a narrow, elongated rectangular or slit-like cross-section, a wire-like corona electrode K which extends across the duct 1, and a target electrode M1 in the form of an electrically conductive surface or coating on the inside of the airflow duct 1, the corona electrode and the target electrode each being connected to a respective terminal of the d.c. voltage source 3. In addition, two further electrodes M2 are arranged axially opposite respective end parts of the corona wire K. These further electrodes M2 comprise electrically conductive surfaces or coatings located adjacent to or on the inside surface of the wall of the airflow duct 1 and are each connected to the same terminal of the d.c. voltage source 3 as the target electrode M1, through a large resistance 4. These further electrodes M2, which are located solely opposite the two end parts of the corona wire K, contribute towards providing a more uniform distribution of the corona current over the whole length of the corona wire K. The two electrodes M2 may also serve, at the same time, as excitation electrodes, in a similar manner to that described in the aforementioned international patent application.

Figure 4:
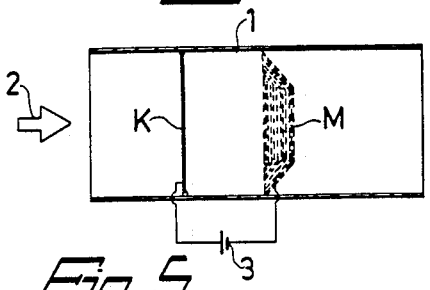
FIGS. 4–6 illustrate schematically and by way of example further embodiments of the invention in which the target electrode comprises a net or grid.

FIG. 4 is a schematic, axial sectional view of a further embodiment of the invention, in which the target electrode M comprises an electrically conductive net or grid. In this case, the net or grid is so curved, or arched, that its axial distance to the cross-sectional plane extending through the duct 1 and incorporating the corona electrode K is shorter at those locations opposite the end parts of the corona electrode than at locations opposite the centre part of said corona electrode. In this way the magnitude of the corona current is balanced evenly over the whole length of the corona electrode K, in the manner described.

Figure 5:
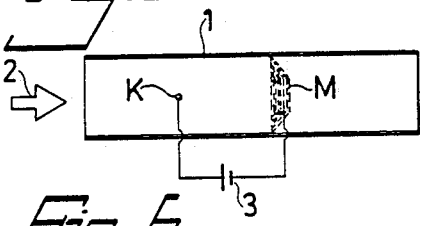

In order to ensure that the velocity of the airflow is as uniform as possible over the entire cross-sectional area of the airflow duct, it is important not only to distribute the corona current as evenly as possible over the whole length of the elongated corona electrode, but also to spread out the ion current from the corona electrode in a lateral direction, i.e. in a direction at right angles to the longitudinal axis of the corona electrode, as evenly as possible over the airflow duct, i.e. even towards the duct side-walls extending parallel with the longitudinal extension of the elongated corona electrode. This can be achieved with a target electrode of the aforedescribed kind illustrated in FIG. 4 in the manner illustrated schematically in FIG. 5, which is a sectional view of the arrangement according to FIG. 4 taken at right angles to the section shown therein. The section in FIG. 5 is thus perpendicular to the elongated corona electrode K. As illustrated in FIG. 5, the net or grid target electrode M is also curved, or arched, so that the axial distance between the cross-sectional plane incorporating the corona electrode K and the target electrode M is shorter at the duct side walls extending parallel with the longitudinal extension of the corona electrode K than within the central part of the duct 1. Thus, the net-like or grid-like target electrode M has, in principle, the configuration of a double-curve or hemisphere. This ensures better propagation of the ion current from the corona electrode K over the whole cross-sectional area of the airflow duct 1.

Figure 6:
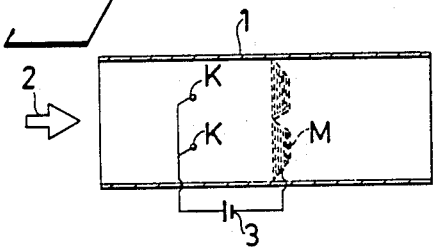

The same result can be achieved when the corona electrode is comprised of a plurality of mutually parallel, elongated, e.g. wire-like, electrode elements placed side-by-side, in the manner illustrated schematically in FIG. 6, which is a sectional view of the air transporting arrangement taken at right angles to the section in FIG. 4. As shown in FIG. 6, the target electrode M is, in this case, formed so that the axial distance between the cross-sectional plane in the duct 1 that contains the corona electrode elements K and the target electrode M is shorter in the region opposite the interspace between said elements than in regions opposite thereto. This affords more uniform propagation of the ion current from the corona electrode elements K over the whole cross-sectional area of the duct 1. It will be understood that the net-like or grid-like target electrode M is, at the same time, curved or arched in the manner illustrated in FIG. 4, so that the axial distance between the cross-sectional plane containing the corona electrode elements K and the target electrode M is shorter at regions opposite the end parts of said elements K than at regions opposite the centre portions thereof.

The target electrode may also have a grid-like configuration which comprises mutually intersecting plate-like or lamella-like strips which extend parallel with the intended direction of air flow, such that the target electrode has a substantial extension in said airflow direction. In the case of target electrode of such construction, the side of the grid facing the corona electrode is formed in the manner aforedescribed with reference to the illustrations of FIGS. 4–6.

Figure 7:
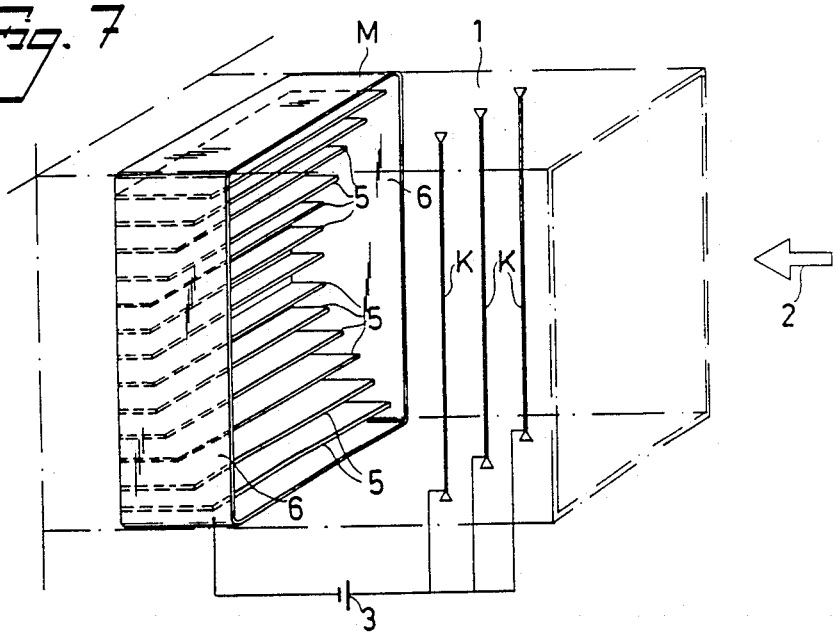

FIG. 7 illustrates schematically a further embodiment of the invention which can be applied to particular advantage in the case of an air transporting arrangement in which the airflow duct 1 has a broader rectangular cross-section, or even a square cross-section, and in which the corona electrode comprises a plurality of wire-like electrode elements K arranged in mutually parallel, side-by-side relationship. In order to ensure that the corona current is distributed as evently as possible over the whole length of the wire-like corona electrodes K, and in order to ensure that the velocity of the airflow is as uniform as possible over the whole cross-sectional area of the airflow duct 1, the target electrode M of this embodiment comprises a plurality of plate-like or lamella-like electrode elements 5 which extend parallel with one another and also with the direction of the air flow 2, and the longitudinal extension of which elements 5 is located at right angles to the longitudinal extension of the wire-like corona electrodes K. The lamella-like target electrodes 5 are also so arranged that the axial distance between the plane incorporating the corona electrodes K and the edges of the target electrode elements 5 facing the corona electrode wires K gradually decreases from the target electrode elements 5 located opposite the centre parts of the corona electrode wires K to the target electrode elements 5 located opposite the end parts of the corona electrode wires K. In this way propagation of the corona discharge is achieved right to the ends of the corona electrode wires K, and a more uniform velocity distribution of the air flow is obtained over the whole cross-sectional area of the airflow duct 1. An advantage is afforded when the target electrode M also includes plate-like or lamella-like electrode elements 6 which are arranged at the respective ends of the lamella-like target electrode elements 5 and located in the proximity of and adjacent to a respective opposing wall in the airflow duct 1. The upstream facing edges of these target electrode elements 6 are therewith advantageously located at the shorter axial distance from the plane containing the corona electrode wires K. This also contributes towards evening out the ion current from the corona electrode wires K in a direction towards the walls of the airflow duct 1, so as to obtain a more uniform flow velocity over the whole cross-sectional area elements 6 are particularly valuable when the target electrode elements 5 extend out to an electrically insulated duct wall. In the exemplifying embodiment illustrated in FIG. 7, the lamella-like target electrode elements 5 are of varying widths, which does not, however, have any important significance with regard to the function of the target electrode in the aforedescribed respects. The important fact is that the edges of the target electrode elements 5 which face the corona electrode wires K are positioned and located in the aforedescribed manner.

Figure 8:
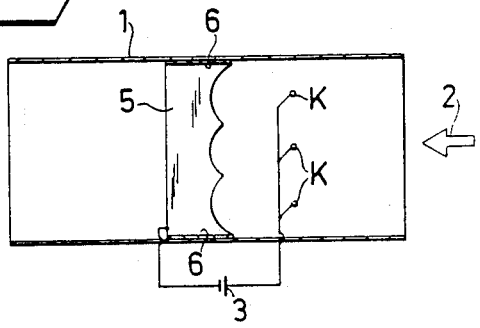
FIGS. 7–9 illustrate schematically, and by way of example, other embodiments of the invention in which the target electrode comprises a plurality of mutually parallel, electrode plates or lamellae arranged perpendicular to the longitudinal axis of the corona electrode.

In the case of a target electrode constructed in the manner illustrated in principle in FIG. 7, the plate-like or lamella-like target electrode elements 5 may advantageously have the form illustrated schematically in FIG. 8, which is a sectional view of the air transporting arrangement taken at right angles to the longitudinal axis of the wire-like corona electrode elements K. As illustrated in FIG. 8, the upstream facing edge of the plate-like or lamella-like target electrode elements 5 directed towards the cross-sectional plane that contains the corona electrode elements K is, in this case, profiled in a manner such that the axial distance between said cross-sectional plane and said edge of the target electrode elements is shorter at a location centrally opposite the interspaces between the corona electrode elements K than opposite said elements. Similar to the manner described with reference to the embodiment illustrated in FIG. 6, there is also obtained here a more uniform dispersal of the ion current from the corona electrode elements K over the whole cross-sectional area of the airflow duct 1.

Figure 9:
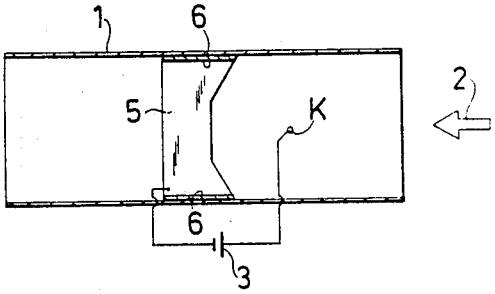

When the corona electrode comprises solely one single wire-like electrode element, the plate-like or lamella-like target electrode elements 5 are suitably formed in the manner illustrated schematically in FIG. 9, which is a sectional view of the air transporting arrangement taken at right angles to the longitudinal axis of the wire-like corona electrode K. The configuration of the edge surfaces of the target electrode elements 5 facing the corona electrode K corresponds to the configuration of the target electrode described in the aforegoing and illustrated in FIG. 5, and affords an improved and more uniform distribution of the ion current from the corona electrode K over the whole cross-sectional area of the airflow duct 1.

An embodiment of the plate-like or lamella-like target electrode elements 5 according to FIG. 8 or FIG. 9 can be used to advantage despite the fact that the target electrode has no plate-like electrode elements 6 located adjacent the duct sidewalls which extend parallel with the longitudinal extension of the corona electrode K.

It will be evident from the aforegoing that many mutually different embodiments of the invention are conceivable. In summary it can be said that the essential feature of the invention is that the target electrode is so formed that the axial distance between the cross-sectional plane which contains the corona electrode and the nearest part of the target electrode is shorter at the end parts of the corona electrode than at the centre regions thereof. Furthermore, when the arrangement comprises a plurality of mutually parallel elongated corona electrodes the target electrode may be so formed that the axial distance between the cross-sectional plane containing the corona electrode and the nearest part of the target electrode is shorter at the duct sidewalls which extend parallel with the longitudinal extension of the corona electrode, and also at the region opposite the interspaces between mutually adjacent corona electrodes, than at the region opposite the actual electrode or electrodes.

In the illustrated and described embodiments the corona electrode K comprises one or more thin rectilinear wires. It will be understood, however, that the invention can also be applied with other types of elongated corona electrodes which extend across the airflow path.

Furthermore, the invention has been described and illustrated with reference to an airflow duct or airflow path, of rectangular or slit-like cross-section, since it is with such cross-sectional configurations that the problem concerned is most prevalent. It will be understood, however, that the invention can be applied with airflow ducts or paths of other cross-sectional shapes, such as circular for instance, since the problem with which this invention is concerned can also occur in those cases.

In the aforegoing an air transporting arrangement according to the invention has been described in detail solely with respect to the configuration of the target electrode. With regard to the remaining construction of an arrangement according to the invention the reader is referred to the aforementioned international patent application. Thus, the arrangement need not include a duct which embraces the electrodes with physical walls. In addition, a suitable screen may be provided upstream of the corona electrode, in order to prevent an ion current from passing upstream from the corona electrode, as described in said international patent application. In all other respects, the configuration and positioning of the various electrodes and the voltage supply thereto may be in accord with the proposals set forth in the aforesaid international patent application.

In those instances in the aforegoing when the target electrode has been referred to as comprising electrically conductive surfaces or elements, it should be observed that the current strength of the ion current passing from the corona electrode to the target electrode in arrangements of the kind described here is very low, and that the term "electrically conductive" must be understood in relation hereto.

We claim:

1. An arrangement for generating a flow of air along a flow path therefor with the aid of an electric ion-wind, comprising at least one thin wire-like corona electrode having first and second opposite ends attached to support means therefor and extending across said flow path in a transverse plane substantially perpendicular to the axial extension of the flow path, at least one target electrode located in said flow path downstream of and spaced from said corona electrode as seen in the axial extension of the flow path and being permeable to a flow of air along said path, and a d.c. voltage source having a first terminal connected to said corona electrode and a second terminal connected to said target electrode for creating a corona discharge at said corona electrode, said target electrode having such a shape that the distance between said transverse plane and said target electrode, as seen in the axial extension of the flow path, is shorter at the ends of said corona electrode than at the center part of the corona electrode located between said ends thereof.

2. An arrangement as claimed in claim 1, wherein said flow path is embraced by an air flow duct of rectangular cross-section and having a first pair of mutually parallel opposite walls which are parallel to the extension of said corona electrode and a second pair of mutually parallel opposite walls which are perpendicular to the extension of said corona electrode, said target electrode having such a shape that the distance between said transverse plane and said target electrode, as seen in the axial extension of the airflow duct, is shorter in the vicinity of said first pair of airflow duct walls than along the central axis of said airflow duct.

3. An arrangement as claimed in claim 1, comprising a plurality of mutually parallel thin wire-like corona electrodes arranged side-by-side in said transverse plane, said target electrode having such a shape that the axial distance between said transverse plane and said target electrode, as seen in the axial extension of said flow path is shorter opposite the interspaces between mutually adjacent corona electrodes than opposite the corona electrodes themselves.

4. An arrangement as claimed in claim 1, wherein said target electrode includes an electrically conductive surface extending parallel to the axial extension of said flow path and surrounding the same, said electrically conductive surface having formed thereon at locations opposite said ends of said corona electrode, as seen in the axial extension of the flow path, portions projecting towards said corona electrode and extending closer to said transverse plane than the remaining portion of said electrically conductive surface forming said target electrode.

5. An arrangement as claimed in claim 1, wherein said target electrode comprises a first electrically conductive surface extending parallel to the axial extension of said flow path and surrounding the same and also two further electrical conductive surfaces located, as seen in the axial extension of the flow path, opposite a respective one of said ends of said corona electrode and between said ends and said first electrically conductive surface, said further electrically conductive surfaces being parallel with the axial extension of the flow path and embracing solely those parts of said flow path that lie downstream of said ends of said corona discharge.

6. An arrangement as claimed in claim 5, wherein said further electrically conductive surfaces are connected to said second terminal of the d.c. voltage source through a large resistance.

7. An arrangement as claimed in claim 4, wherein said flow path is embrace by an airflow duct having walls extending in the axial extension of the flow path, said electrically conductive surfaces of the target electrode being arranged adjacent to or on the walls of said flow duct.

8. An arrangement as claimed in claim 1, wherein said target electrode comprises a net extending across said flow path and being so curved as to fulfill said conditions regarding the distance between said transverse plane and the target electrode.

9. An arrangement as claimed in claim 1, wherein said target electrode comprises a grid-like structure extending across said flow path an composed of elongated lamella-like mutually intersecting strips arranged with their side surfaces parallel with the axial extension of the flow path, the side of said grid-like structure facing said corona electrode being so constructed as to fulfil said conditions regarding the distance between said transverse plane and the target electrode.

10. An arrangement as claimed in claim 1, wherein said target electrode comprises a plurality of elongated lamella-like electrode strips extending mutually parallel across said flow path in a direction perpendicular to the direction of extension of said corona electrode, each of said electrode strips having a first longitudinal edge facing upstream in said flow path and a second longitudinal edge facing downstream in the flow path and side surfaces between said longitudinal edges which side surfaces are parallel with the axial extension of the flow path, said electrode strip being so arranged that the distances between said transverse plane and said upstream facing edges of the electrode strips, as seen in the axial extension of the flow path, decreases gradually from the electrode strips located opposite a central part of said electrode to the electrode strips located opposite said ends of the corona discharge.

11. An arrangement as claimed in claim 10, wherein said upstream facing edge of said electrode strip is so formed that the distance between said transverse plane and said upstream facing edge, as seen in the axial extension of the flow path, is shorter at the ends of the electrode strip than at the center part thereof.

12. An arrangement as claimed in claim 10, comprising a plurality of thin wire-like corona electrodes arranged mutually parallel and mutually spaced in said transverse plane, said upstream facing edge of each of said target electrode strips being so formed that the distance between said transverse plane and said upstream facing edge, as seen in the axial extension of the flow path, is shorter opposite the interspaces between mutually adjacent corona electrodes than opposite the actual corona electrodes themselves.

13. An arrangement as claimed in claim 10, wherein said target electrode comprises two additional elongated lamella-like electrode strips arranged at the opposite ends of said first mentioned target electrode strips and extending perpendicular to these.

* * * * *